US005157953A

United States Patent [19]

Hung

[11] Patent Number: 5,157,953

[45] Date of Patent: Oct. 27, 1992

[54] PUSH AND PULL TYPE CYLINDER LOCK

[76] Inventor: Sheng-Hu Hung, P.O. Box 55-1670, Taipei (10477), Taiwan

[21] Appl. No.: 587,266

[22] Filed: Sep. 24, 1990

[51] Int. Cl.[5] ..... E05C 1/12

[52] U.S. Cl. ..... 70/224; 70/216; 292/170

[58] Field of Search ..... 70/207, 208, 215-217, 70/223, 224, DIG. 20; 292/170, 336.3

[56] References Cited

U.S. PATENT DOCUMENTS

| | | | |
|---|---|---|---|
| 2,547,108 | 4/1951 | Anderson | 292/170 |
| 2,589,405 | 3/1952 | Lang | 292/170 |
| 2,708,357 | 5/1955 | Ahlquist | 70/216 |
| 2,939,737 | 6/1960 | Nygren | 292/170 |
| 2,960,858 | 11/1960 | Webster | 292/170 X |
| 3,121,319 | 2/1964 | Webster | 292/170 X |
| 3,172,281 | 3/1965 | Tugle | 292/170 X |
| 3,385,622 | 5/1968 | Winger | 292/170 |
| 3,582,121 | 6/1971 | Rollins | 292/170 |
| 4,040,652 | 8/1977 | Arfelt et al. | 292/170 X |
| 4,777,810 | 10/1988 | Webster | 292/170 X |

FOREIGN PATENT DOCUMENTS

| | | | |
|---|---|---|---|
| 1052855 | 3/1959 | Fed. Rep. of Germany | 70/217 |
| 528556 | 6/1955 | Italy | 70/217 |
| 146481 | 7/1931 | Switzerland | 70/217 |

*Primary Examiner*—Alexander Grosz
*Assistant Examiner*—Suzanne L. Dino

[57] ABSTRACT

A cylinder lock includes an outer handle formed on an outside of a door having a tumbler lock formed in the outer handle, an inner handle formed on an inside of the door having an inner rotating knob formed in the inner handle, an actuator laterally formed in a central portion of the two handles for operatively pulling a latch bolt inwardly for opening the door from a door frame, an outer slide slidably mounted in the two handles which can be pushed inwardly upon a depression on the outer handle from outside the door to retract the actuator and the latch bolt for opening the door when the door is unlocked, and an inner slide slidably held in the two handles which can be pulled inwardly to retract the actuator and the latch bolt also for opening the door from inside the door.

8 Claims, 6 Drawing Sheets

PUSH AND PULL TYPE CYLINDER LOCK

BACKGROUND OF THE INVENTION

A conventional cylinder lock includes two knobs respectively formed inside and outside a door, in which either knob can be rotated for opening the lock when a correct key is inserted in the pin tumblers. However, such a conventional cylinder lock may still have the following drawbacks:

1. Either outer or inner knob should be rotated for opening the door. If the rotation angle for example one turn of 360 degrees is not enough, the door may not be opened, which is not suitable for an emergency escape.
2. It is not convenient for opening the door by someone whose two hands already carries a goods.
3. The cylinder lock once being locked may still be intentionally opened by an intruder who uses an auxiliary tool such as a pipe wrench, since the cylinder handle is secured with the locking latch.

The present inventor has found the drawbacks of a conventional cylinder lock and invented the present cylinder lock operated by push or pull action.

SUMMARY OF THE INVENTION

The object of the present invention is to provide a cylinder lock which can be opened either by pushing an outer handle or by pulling an inner handle inwardly for retracting a latch bolt from its locked state for a convenient door opening operation without requiring a rotation of an outer knob or an inner knob of the cylinder lock.

DETAILED DESCRIPTION

Figure 1:
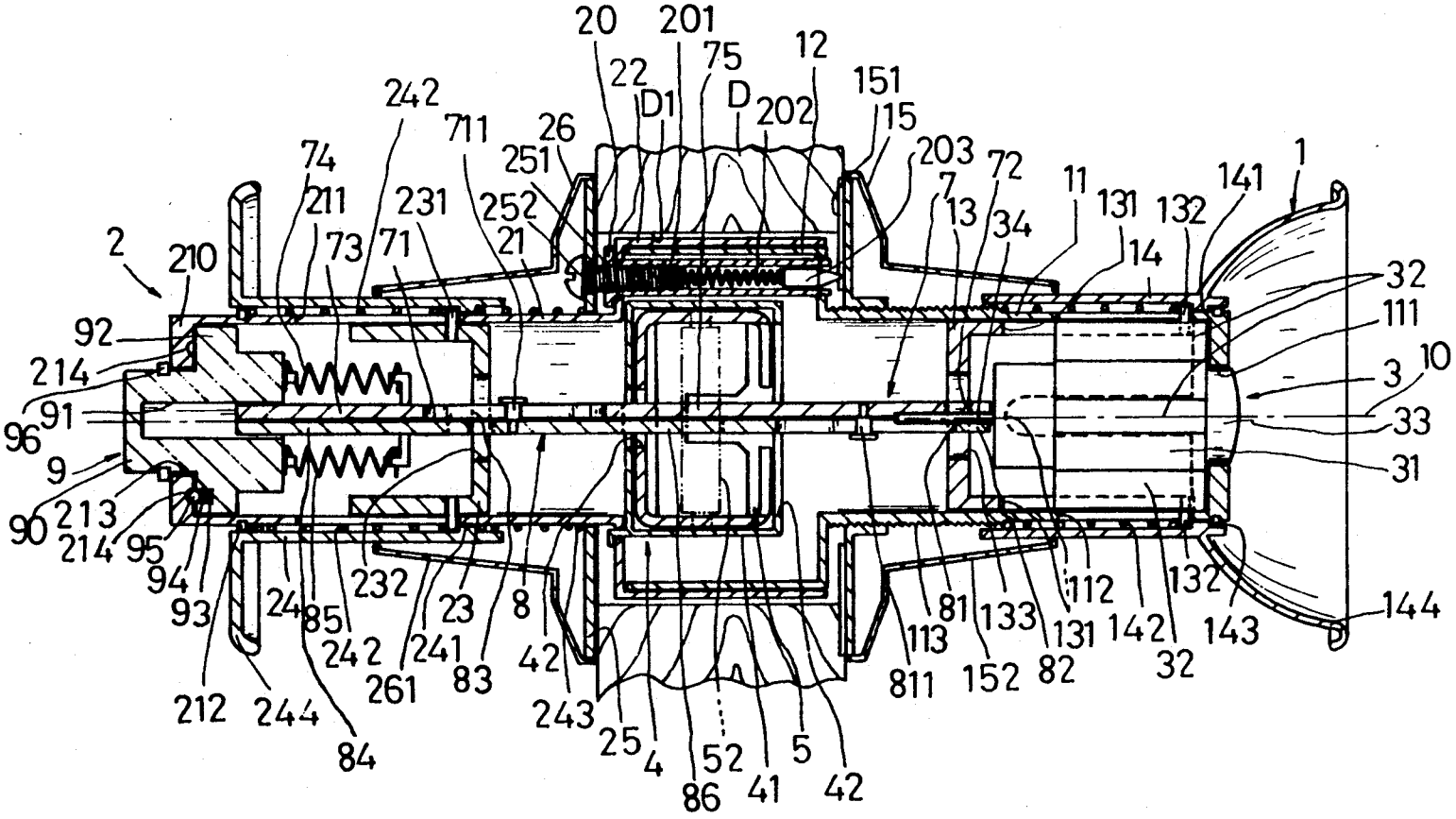
FIG. 1 is a front elevational sectional drawing of the present invention as assembled.

As shown in FIGS. 1-7, the present invention comprises: an outer handle means 1, an inner handle means 2, a tumbler lock means 3, a guide base 4, a latch bolt actuator 5, a latch bolt means 6, an outer-handle-operated slide 7, an inner-handle-operated slide 8, and an inner rotating knob 9.

The outer handle means 1 includes an outer cylinder 11 having a first central enlarged cylindrical portion 12 slidably engageable with a second central enlarged cylindrical portion 22, both cylindrical portions 12, 22 being fixed with a plurality of hollow bolts 20 for coaxially mounting the outer handle means 1 and the inner handle means 2 in a lock hole D1 formed in the door D along a longitudinal axis 10.

The tumbler lock means 3 includes a lock cylinder 31 having a plurality of radial protrusions 32 secured with the outer cylinder, a key hole 33 formed in an outer end portion of the lock means 3 for inserting a key not shown therein, and a driving plate 34 formed on an inner end of the lock means 3 which is rotated in every 180 degrees when driven by a key along a central axis 10 coaxially aligned between the two handle means 1, 2. The lock means 3 may be formed with any conventional locking mechanism, such as pin tumbler lock having an "outer cylinder" encasing a rotating "inner cylinder" or plug (not shown) for operatively rotating the driving plate 34.

The outer handle means 1 further includes a first sleeve 13 generally cylindrical shaped slidably held in the outer cylinder 11 having a plurality of radial keys 132 secured on an outer end portion of the sleeve 13 and slidably moving in a plurality of longitudinal slots 112 formed in the outer cylinder 11 and having plurality of radial slots 131 slidably engageable with the plural protrusions 32 of the lock means 3, and an outer jacket 14 generally cylindrical shaped and slidably disposed around the outer cylinder 11, having an annular extension ring 141 formed on an outer portion of the jacket 14 and operatively retained by the radial keys 132 of the first sleeve 13, a first tensioning spring 142 having its inner spring end retained on an outer end portion of a male-threaded portion 113 of the outer cylinder 11 and having an outer spring end retained on the radial keys 132, a retainer ring 143 secured on an outer end portion of the outer cylinder 11 for limiting the annular extension ring 141, and an outer handle 144 formed on an outermost end portion of the handle means 1.

An outer cover plate 15 includes a female-threaded portion engageable with the male-threaded portion 113, plural radial teeth formed on an inside surface of the plate 15 to be firmly secured on an outer surface of the door D, and a cone portion 152 for shielding an inner portion of the jacket 14.

The inner handle means 2 includes: an inner cylinder 21 having a second enlarged cylindrical portion 22 formed on its central portion, a second sleeve 23 slidably held in the inner cylinder 21 having plural radial keys 231 slidably moving in a plurality of longitudinal slots 211 formed in the inner cylinder 21, an inner jacket 24 generally cylindrical shaped slidably disposed around the inner cylinder 21, a washer 25 fixed on an inner door surface of the door by screws 252 of which each screw 252 is firmly fixed with a screw hole 201 formed in the hollow bolt 20 securing both the two central enlarged portions 22, 12, an inner cover plate 26 embedded on an outer perimeter of the washer 25 having a cone portion 261 partially shielding the inner jacket 24, and an inner handle 244 secured to the inner jacket 24 for door-opening operation.

The guide base 4 is generally formed as a cube cage 41 secured and defined in the two central enlarged portions 12, 22 of the inner cylinder 11 and outer cylinder 21 for slidably reciprocating a latch bolt actuator 5 in the cage 41 along a latitudinal axis 40 perpendicular to the longitudinal axis 10 and extrapolating to an axis 60 of the latch bolt means 6 towards a side wall D2 of door D and door frame C.

The latch bolt actuator 5 generally formed as a cube frame 50 slidably held in the cage 41 of the guide base 4 includes a front plate 51 secured with a guide rod 61 of the latch bolt means 6, a roller 52 vertically formed in the cube frame 50 of the actuator 5 having a roller axis 521 perpendicular to the axis 40, 60, and a latch restoring spring 53 retained between the cube frame 50 and the inner cylinder 12 for normally urging the actuator 5 and latch bolt 62 of the latch bolt means 6 outwardly to be locked into a latch socket 63 formed in the door frame C through a side hole 121, 221 formed in the enlarged portion 12, 22.

The outer-handle-operated slide 7 is formed with a longitudinal slot 71 in its inner portion slidably coupled with a pin 711 having a top head thereon fixed on the inner-handle-operated slide 8; whereas the inner-handle-operated slide 8 is formed with a longitudinal slot 81 on its outer portion slidably coupled with a pin 811 having a top head thereon fixed on the outer-handle-operated slide 7.

The slidably coupled slides 7, 8 each respectively includes a central portion 70, 80 slidably held in a central hole 42 of the guide base 4 and a guide slot 64 formed in the frame 50 of the actuator 5. Two slides 7, 8 have their front end portions jacketed on the driving plate 34 of the lock means for operative turning of every 180 degrees upon the rotation of the lock means 3 when inserted with a key.

The outer-handle-operated slide 7 includes a neck portion 133 of its outer end portion secured on a central hole 133 of the first sleeve 13, a rear guide plate 73 formed on an inner portion of the slide 7 slidably passing through a central hole 232 formed in the second sleeve 23 to be protruded and defined in a central socket 91 of the rotating knob 9, and a outer slide spring 74 retaining the guide plate 73 on the knob 9 to normally urge the slide 7 towards the outer cylinder 11.

The inner-handle-operated slide 8 includes an outer guide plate 82 slidably held in the central hole 133 of sleeve 13 commonly clamping the driving plate 34 of lock mean 3 in cooperation with the neck portion 72 of slide 7, a rear neck portion 83 formed on an inner portion of the slide 8 secured on the central hole 232 of the sleeve 23, and an inner guide plate 84 protruding rearwardly or inwardly from the neck portion 83 to poke into socket 91 of knob 9, an inner slide spring 85 retaining the guide plate 84 on the knob 9 to normally urge the slide 8 towards the outer cylinder 11.

The central portions 70, 80 of the two slides 7, 8 are respectively formed with two central slim plates 75, 86. The slide 7 includes a sloping surface portion 76 diverging outwardly towards the outer cylinder 11 from one side of the central slim portion 76 and a recess 77 formed on an opposite side of the sloping surface portion 76 adjacent to the central slim portion 75.

The slide 8 includes two sloping surface portions 87, 88 diverging outwardly from the central slim portion 86 and disposed on two opposite sides about the central axis 10. The sloping surface portion 87 of slide 8 is projectively coincided with the sloping surface portion 76 of the slide 7 when the lock means 3 is unlocked. Each sloping surface portion 76, 87, 88 may thrust the roller 52 to retract the actuator 5 and latch bolt means 6 for opening the door.

The inner rotating knob 9 includes a shoulder portion 92 rotatably engageable with an inner flange 210 of the inner cylinder 21 and a knob stem 90 rotatably engageable with a central hole 213 of the flange 210 as retained by a retainer 96. Two ball sockets 214 are diametrically formed in the flange 210, being separated with each other at 180 degrees. A steel ball 95 resiliently held in a spring socket 93 recessed in the shoulder portion 92 of knob 9 operatively and rotatably engageable with either socket 214. The outside surface of the knob 9 or flange 210 may also be marked with "locked" or "unlocked".

The inner jacket 24 is formed with an annular extension 241 slidably disposed around the inner cylinder 11 engageable with the radial keys 231 of the sleeve 23. A retainer ring 212 is formed on an inner periphery of the inner cylinder 21 slidably retained in the inner jacket 24. A second tensioning spring 242 is resiliently retained between the retainer ring 212 and the radial keys 231 normally urging the jacket 24 outwardly towards the outer cylinder 11. A jacket spring 243 is retained between the washer 25 and the annular extension 241 of the jacket 24 for resiliently positioning the inner jacket 24 ready for door-opening operation.

The screw 252 mounted in the hollow bolt 20 resiliently forces, by means of a bolt spring 202 as shown in FIG. 1, a nail with acute tip 203 on the radial teeth 251 of the outer cover plate 15 for preventing a dismantling of the outer handle means 1 from outside the door D.

Figure 2:
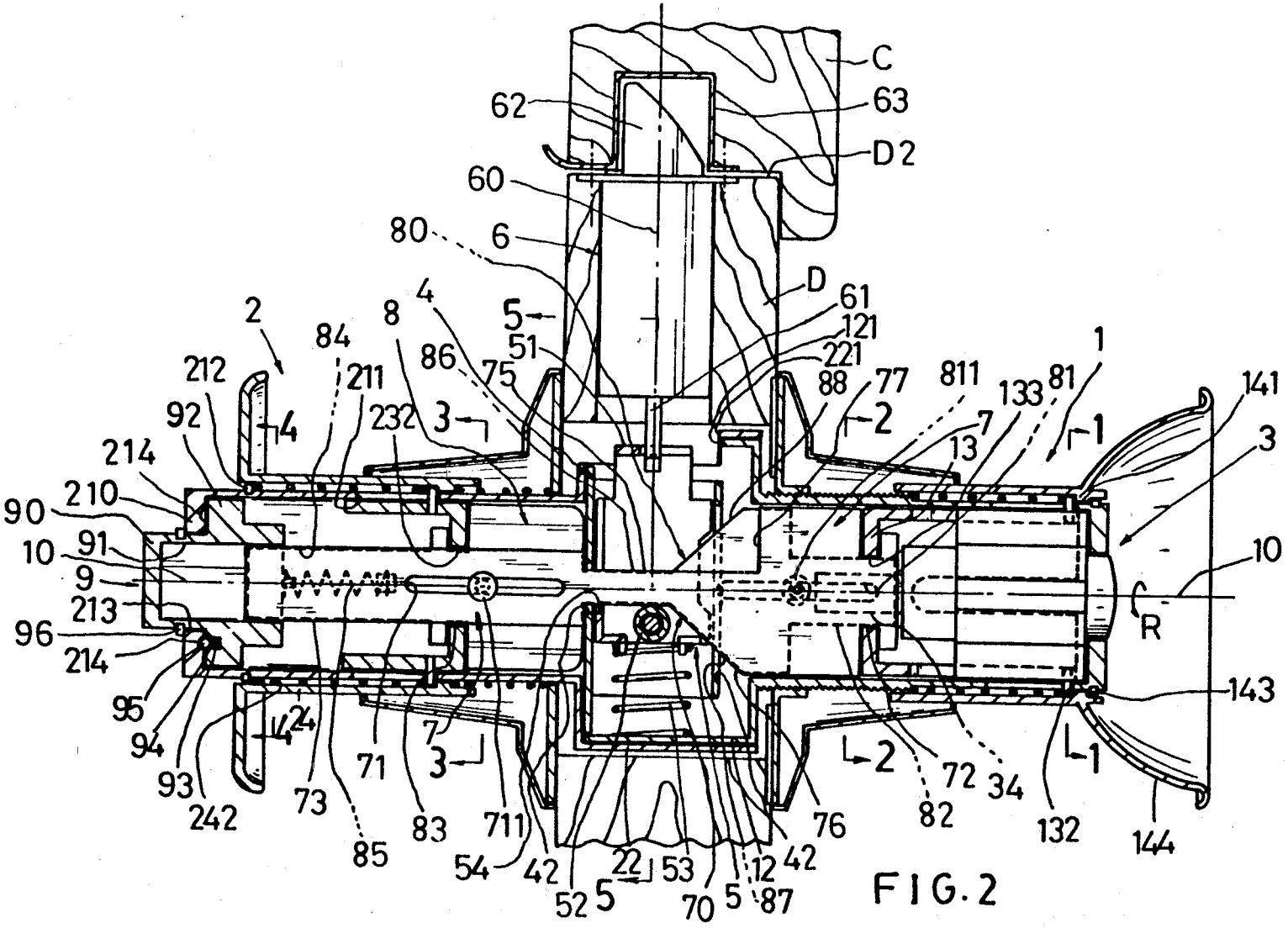
FIG. 2 is a top view sectional drawing of the present invention.
Figure 3:
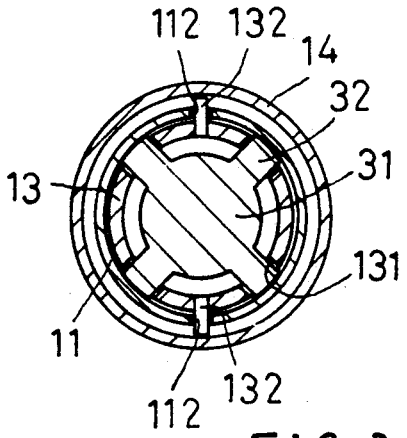
FIG. 3 is a cross sectional drawing when viewed from 1—1 direction of FIG. 2.
Figure 4:
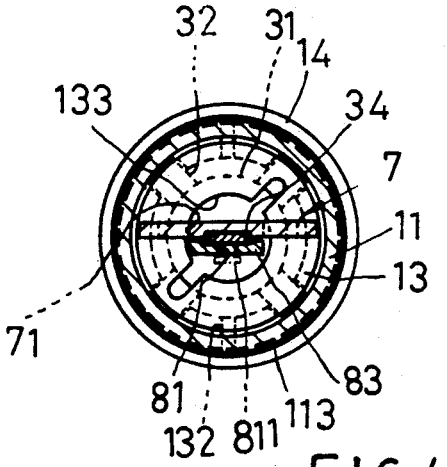
FIG. 4 is a cross sectional drawing when viewed from 2—2 direction of FIG. 2.
Figure 5:
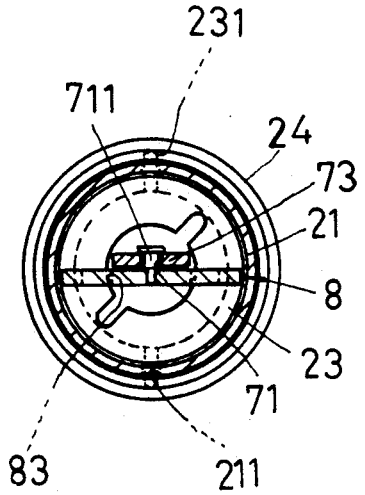
FIG. 5 is a sectional drawing as viewed from 3—3 direction of FIG. 2.
Figure 6:
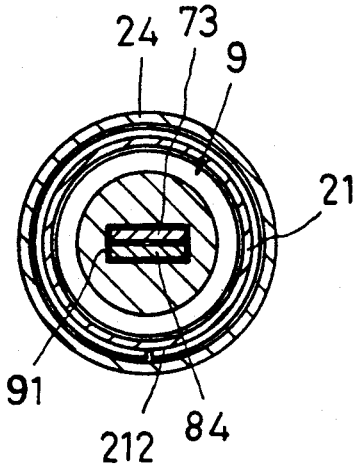
FIG. 6 is a sectional drawing as viewed from 4—4 direction of FIG. 2.
Figure 7:
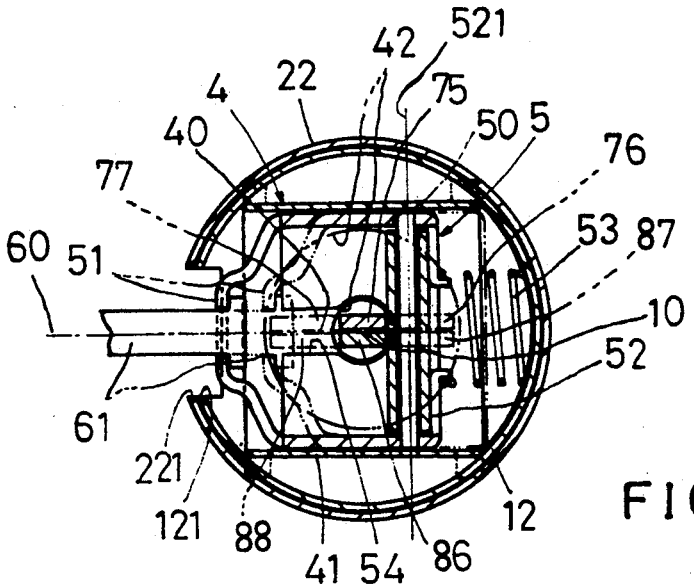
FIG. 7 is a sectional drawing as viewed from 5—5 direction of FIG. 2.
Figure 8:
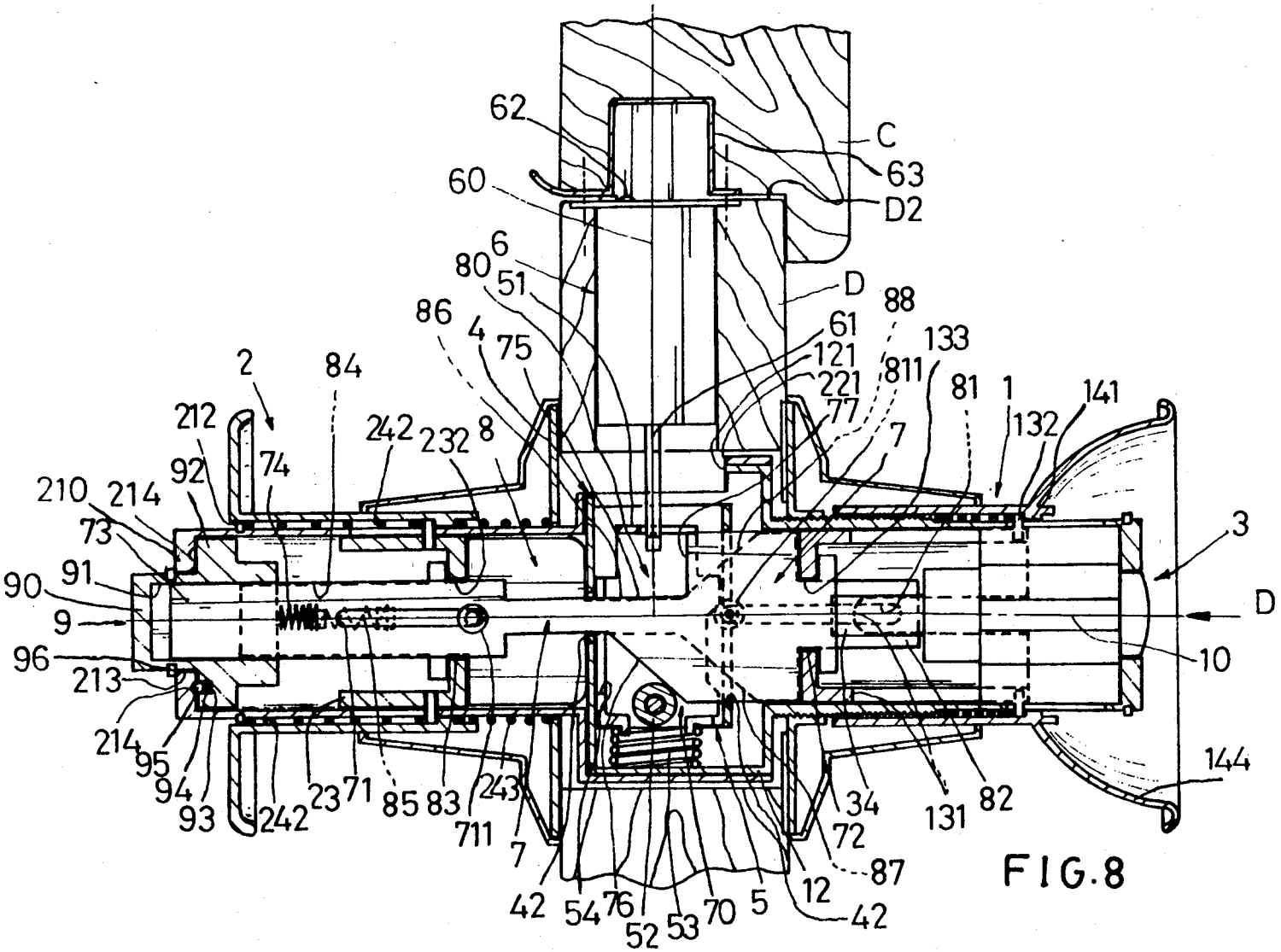
FIG. 8 is an illustration of the present invention showing a door opening when opened from outside the door.

When opening the door D from outside the door of the present invention as unlocked as shown in FIG. 2, the outer handle 144 is depressed (D) inwardly as shown in FIG. 8 to allow the annular ring 141 to urge radial keys 132 to move sleeve 13 and outer slide 7 so that the sloping surface portion 76 will push to retract the roller 52, thereby pulling the actuator 5, and retracting the latch bolt 62 of the latch bolt means 6 for opening the door D from the door frame C. After releasing the depression of outer handle, the springs 142, 74 will restore the outer jacket 14 and slide 7 outwardly ready for next depression operation.

Figure 9:
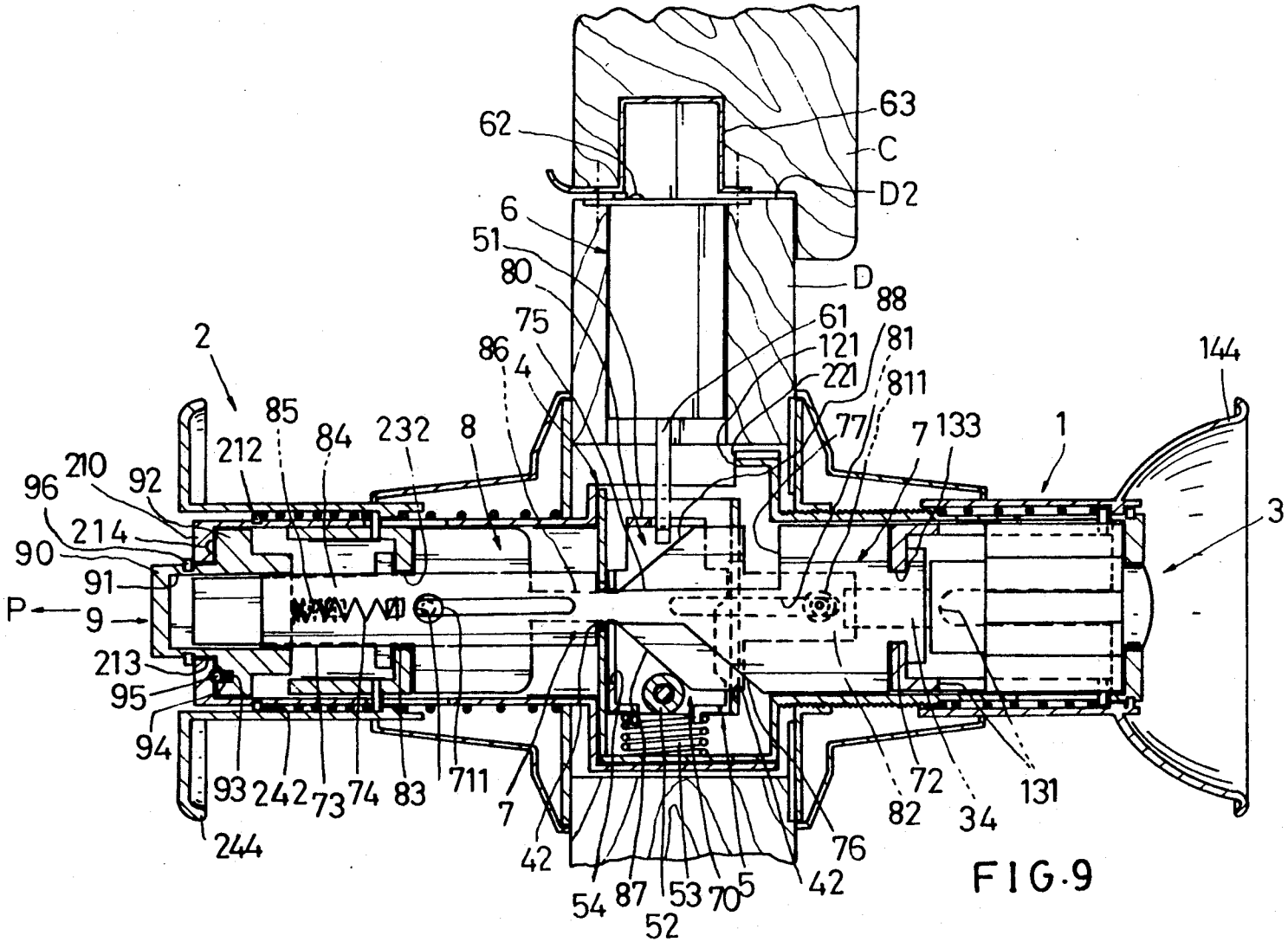
FIG. 9 shows a door when opened from inside the door.

For opening the door D from inside the door as shown in FIG. 9, the inner handle 244 is pulled inwardly (P) to pull the inner sleeve 23, the inner slide 8 to allow the sloping surface portion 87 to retract roller 52 of actuator 5 to retract bolt 62 of latch bolt means 6 for opening the door. After releasing the pulling operation, the springs 242, 85 will restore the inner cylinder 244 and the slide 8 and the spring 53 will restore the roller 52 to extend the latch bolt 62 to be engageable with the socket 63 formed in door frame C.

Figure 10:
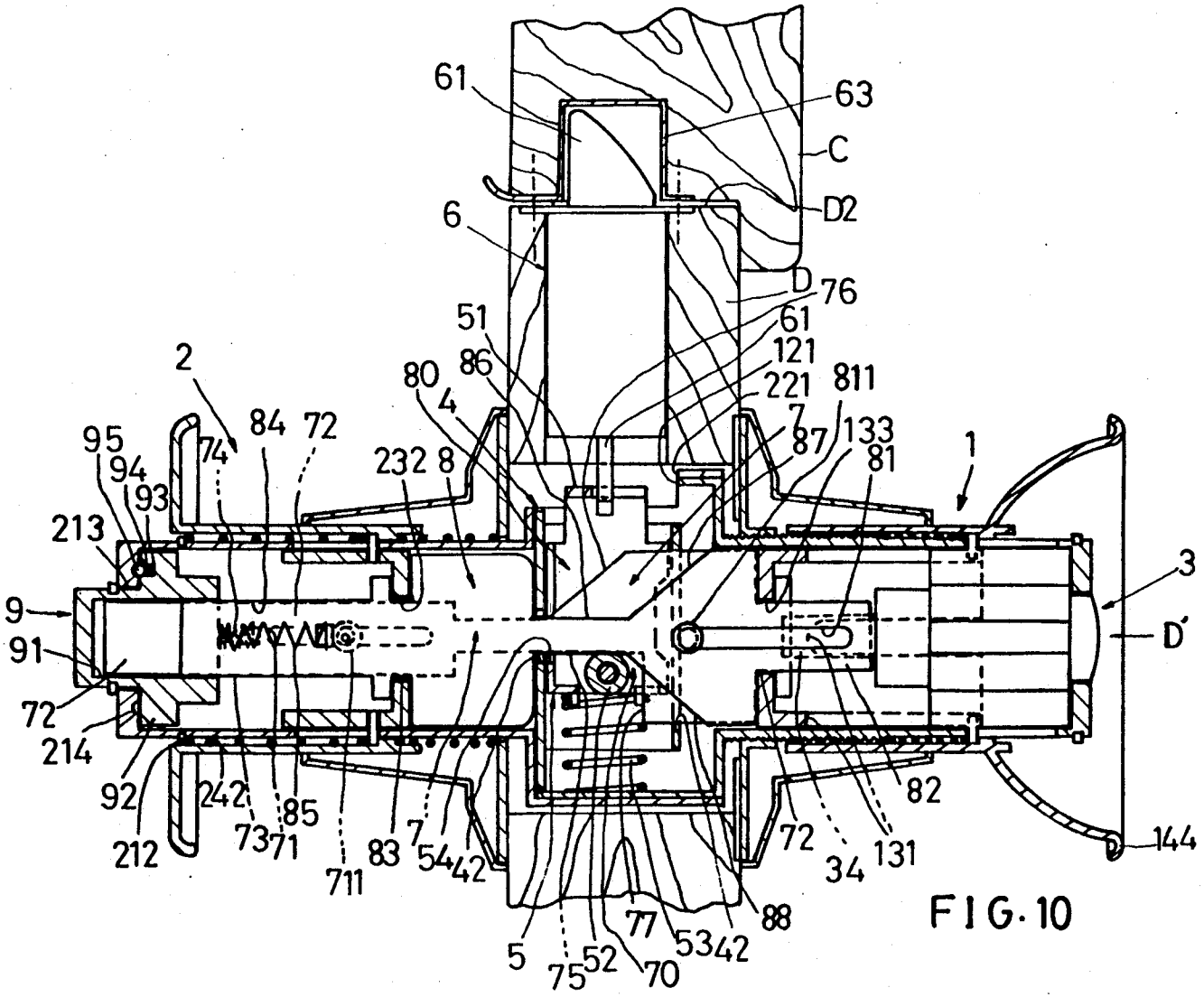
FIG. 10 shows a locked door in accordance with the present invention.

For locking the door of the present invention, a key (not shown) is inserted into a key hole of the lock means 3 from outside the door or the inner knob 9 is rotated from inside the door to rotate the two slides 7, 8 at 180 degrees from its unlocked position such as by rotating the slide 7, 8 in direction R as shown in FIG. 2 for a rotating angle of 180 degrees, whereby a further depression (D') on the outer handle 144 to push the outer slide 7 inwardly without retracting the roller 52 and latch bolt 62 since the recess 77 of the slide 7 will not touch the roller 52 as shown in FIG. 10, thereby unable to open the door.

At this time, the inner handle 244 can still be pulled to allow the sloping surface portion 88 of the inner slide 8 to push the roller 52 to retract the latch bolt 62 capable for opening the door from inside the door even locking the lock means 3 formed in the outer handle means 1.

For unlocking the door, the inner knob 9 is rotated at 180 degrees or the lock means 3 is unlocked to rotate the driving plate 34 for rotating the two slides 7, 8 at 180 degrees to allow the sloping surface portion 76 to possibly push the roller 52 for retracting the latch bolt 62 for opening the door.

When depressing the outer handle 114 to move the outer slide 7 inwardly the front pin 811 secured on slide 7 freely moves along the slot 81 formed in slide 7 without being obstructed, and the rear pin 711 will not obstruct the moving of slide 7 as freely passing through the slot 71 formed in the slide 7. The inward pulling of the inner handle 244 is similar since both pins 711, 811 are freely passing through the two slots 71, 81 formed in the two slides 7, 8.

The present invention is superior to a conventional cylinder lock with the following advantages:

1. The outer handle or inner handle is pushed or pulled for opening the door, without rotating the handle, for a very convenient door opening or closing operation.

2. Even someone carring a goods with his two hands, an unlocked door can be easily opened just by depression or pulling operation for an ergonomic and safer door opening operation.

3. The outer handle or jacket 14 is not directly coupled or connected to the latch bolt means 6 so that the latch bolt means 6 can not be easily unlocked for ensuring its security value.

I claim:

1. A push and pull type cylinder lock comprising:

an outer handle means having an outer handle formed on an outside of a door having a tumbler lock means formed in said outer handle means, said outer handle means including an outer cylinder having a first enlarged cylindrical portion formed on its central portion, a first sleeve slidably held in said outer cylinder having a plurality of radial keys slidably moving in a plurality of longitudinal slots formed in the outer cylinder, an outer jacket generally cylindrically shaped slidably disposed around the outer cylinder having said outer handle formed thereon, an outer cover plate fixed on an outer surface of said door and partially shielding said outer jacket;

an inner handle means having an inner handle formed on an inside of the door having an inner rotating knob rotatably mounted in said inner handle means, said inner handle means including an inner cylinder having a second enlarged cylindrical portion formed on its central portion, a second sleeve slidably held in the inner cylinder having plural radial keys of said second sleeve slidably moving in a plurality of longitudinal slots formed in the inner cylinder, an inner jacket generally cylindrically shaped slidably disposed around the inner cylinder, a washer fixed on an inner door surface of the door by screws of which each screw is firmly fixed with a screw hole formed in a hollow bolt securing both the two central enlarged portions of the two handle means, an inner cover plate embedded on an outer perimeter of the washer having a cone portion partially shielding the inner jacket, and said inner handle secured to the inner jacket for door-opening operation;

both said outer handle means and said inner handle means formed on said door about a coaxial longitudinal axis normal to the door;

a guide base formed in a central portion of said outer handle means and said inner handle means;

a latch bolt actuator slidably mounted in said guide base along a latitudinal axis perpendicular to said longitudinal axis of both said handle means;

a latch bolt means formed on a laterial side of said central portion of two said handle means having a latch bolt operatively engageable in a bolt socket formed in a socket of a door frame for closing said door thereon, said latch bolt being operatively pulled by said latch bolt actuator for opening said door and having a longitudinal axis of said latch bolt means aligned with said latitudinal axis of said actuator;

an outer-handle-operated slide slidably mounted in both said handle means operatively thrusting said actuator to retract said latch bolt for opening said door upon an inward depression on said outer handle from outside the door; said outer-handle-operated slide including: a neck portion formed on its outer end portion secured on a central hole of the first sleeve, a rear guide plate formed on an inner portion of the outer-handle-operated slide slidably passing through a central hole formed in the second sleeve to be protruded and defined in a central socket formed in the rotating knob, and an outer slide spring retaining the guide plate on the rotating knob to normally urge the outer-handle-operated slide towards the outer cylinder, a longitudinal slot formed on an inner portion of said outer-handle-operated slide slidably coupled with a pin having a top head formed thereon fixed on the inner-handle operated slide, and a first sloping surface portion diverging outwardly towards said outer cylinder from one side portion of a first central slim portion of said outer-handle-operated slide, and a recess formed on an opposite side portion of said first central slim portion, said first sloping surface portion operatively thrusting a roller formed in said actuator for retracting said latch bolt for opening the door, said recess separated from said roller of said actuator thereby being unable for thrusting said roller of said actuator for locking the door; and an inner-handle-operated slide slidably mounted in both said handle means also operatively thrusting said actuator to retract said latch bolt for opening the door from inside the door when pulling said inner handle inwardly, said inner-handle-operated slide including: an outer guide plate slidably held in the central hole of first sleeve commonly clamping a driving plate formed on an inner portion of said lock means in cooperation with the neck portion of said outer-handle-operated slide, a rear neck portion formed on an inner portion of the inner-handle-operated slide secured on a central hole of the second sleeve, and an inner guide plate protruding rearwardly or inwardly from the rear neck portion to poke into the socket of the rotating knob, an inner slide spring retaining the inner guide plate on the knob to normally urge the inner-handle-operated slide outwardly towards the outer cylinder, a second and a third sloping surface portion respectively diverging outwardly from a second central slim portion of the inner-handle-operated slide and disposed on two opposite sides about the longitudinal axis of said two handles, the second sloping surface portion of the inner-handle-operated slide projectively coincided with the first sloping surface portion of the outer-handle-operated slide when the lock means is unlocked, both second and third sloping surface portions operatively thrusting said roller of said actuator for opening the door, and a longitudinal slot formed on an outer portion of the inner-handle-operated slide slidably coupled with a second pin having a top head formed thereon fixed on the outer-handle-operated slide.

2. A cylinder lock according to claim 1, wherein said outer handle means includes said outer jacket having an annular extension ring formed on an outer portion of the jacket and operatively retained by the radial keys of the first sleeve, a first tensioning spring having its inner spring end retained on an outer end portion of a male-threaded portion of the outer cylinder and having an outer spring end retained on the radial keys, a retainer ring secured on an outer end portion of the outer cylinder for limiting the annular extension ring, and said outer handle formed on an outermost end portion of the outer handle means, and said outer cover plate having a female-threaded portion engageable with the male-threaded portion of said outer cylinder, a plurality of radial teeth formed on an inside surface of the cover plate to be firmly secured on an outer surface of the door, and a cone portion for shielding an inner portion of the outer jacket.

3. A cylinder lock according to claim 1, wherein said guide base is generally formed as a cube cage secured and defined in the two central enlarged portions of the inner cylinder and outer cylinder for slidably reciprocating the latch bolt actuator in the cage along the latitudinal axis of the actuator perpendicular to the longitudinal axis of the two handle means and extrapolating to said longitudinal axis of the latch bolt means towards the door frame.

4. A cylinder lock according to claim 1, wherein said latch bolt actuator generally formed as a cube frame slidably held in the cage of the guide base includes a front plate secured with a guide rod of the latch means, said roller vertically formed in the cube frame of the actuator having a roller axis perpendicular to the latitudinal axis, and a latch restoring spring retained between the cube frame and the inner cylinder for normally urging the actuator and latch bolt of the latch bolt means outwardly to be locked into a latch bolt socket formed in the door frame through a side hole each formed in the enlarged portion of the two handle means.

5. A lock cylinder according to claim 1, wherein said inner rotating knob includes a shoulder portion rotatably engageable with an inner flange of the inner cylinder and a knob stem rotatably engageable with a central hole of the flange as retained by a retainer, two ball sockets diametrically formed in the flange, being separated with each other at 180 degrees, and a steel ball resiliently held in a spring socket recessed in the shoulder portion of said knob operatively and rotatively engageable with either of the two ball sockets.

6. A lock cylinder according to claim 1, wherein said inner handle means includes said inner jacket having an annular extension slidably disposed around the inner cylinder engageable with the radial keys of the second sleeve, a retainer ring formed on an inner periphery of the inner cylinder slidably retained in the inner jacket, a second tensioning spring resiliently retained between the retainer ring of the inner cylinder and the radial keys of the second sleeve normally urging the inner jacket outwardly towards the outer cylinder, and an inner jacket spring retained between the washer and the annular extension of the inner jacket for resiliently positioning the inner jacket ready for door-opening operation.

7. A lock cylinder according to claim 1, wherein said screw for fixing said washer of said inner handle means is fixed in the hollow bolt resiliently outwardly forcing a nail having acute tip by a bolt spring on the radial teeth of the outer cover plate of the outer handle means.

8. A lock cylinder according to claim 1, wherein said tumbler lock means includes a driving plate formed on an inner end portion of the lock means which is rotated in every 180 degrees when driven by a key along the longitudinal axis coaxially aligned between the two handle means.

* * * * *